United States Patent [19]

Saeki et al.

[11] Patent Number: 4,956,027

[45] Date of Patent: Sep. 11, 1990

[54] TREATMENT OF CHROMATE COATING

[75] Inventors: Kenshi Saeki, Kanagawa; Noriaki Yoshitake, Tokyo; Takayuki Aoki, Kanagawa, all of Japan

[73] Assignee: Nihon Parkerizing Co., Ltd., Tokyo, Japan

[21] Appl. No.: 313,330

[22] Filed: Feb. 21, 1989

Related U.S. Application Data

[63] Continuation of Ser. No. 57,067, Jun. 1, 1987, abandoned.

[30] Foreign Application Priority Data

Jun. 13, 1986 [JP] Japan ..... 61-136030

[51] Int. Cl.[5] ..... C23C 22/30

[52] U.S. Cl. ..... 148/257; 148/265; 148/267; 148/269

[58] Field of Search ..... 148/269, 265, 267, 257

[56] References Cited

U.S. PATENT DOCUMENTS

| | | | |
|---|---|---|---|
| 2,768,104 | 10/1956 | Schuster | 148/6.2 |
| 2,777,785 | 1/1957 | Schuster | 148/6.2 |
| 3,493,441 | 2/1970 | Rausch | 148/6.2 |
| 3,535,168 | 10/1970 | Thompson | 148/6.2 |
| 3,620,777 | 11/1971 | Okabe | 148/6.2 |
| 3,932,198 | 1/1976 | Schneider | 148/6.2 |
| 3,935,035 | 1/1976 | Tanaka | 148/6.2 |

*Primary Examiner*—Sam Silverberg

*Attorney, Agent, or Firm*—Ernest G. Szoke; Wayne C. Jaeschke; Norvell E. Wisdom, Jr.

[57] ABSTRACT

An aqueous solution of a reducing agent is applied to a chromate coated metal surface to reduce the extent to which the chromate coating undergoes dissolution during a subsequent cleaning process.

11 Claims, 1 Drawing Sheet

TREATMENT OF CHROMATE COATING

CROSS REFERENCE TO RELATED APPLICATION

This application is a continuation of application Ser. No. 07/057,067 filed June 1, 1987 and now abandoned.

BACKGROUND OF THE INVENTION

The present invention concerns a process for reducing dissolution during subsequent cleaning of a coating having chromic acid or chromate as the principal constituent which coating has been applied to metal sheet such as steel sheet, aluminum sheet or plated steel sheet such as zinc plated steel and zinc-alloy plated steel (e.g. Zn-Al, Zn-Ni, Zn-Fe, Zn-Mn etc.).

It has commonly been known and applied to practical use in each sector concerned that formation, with subsequent drying, of a chromate coating by applying an aqueous solution having chromic acid or chromate as a principal constituent to steel sheet, aluminum sheet and plated steel sheet can provide them with improved corrosion resistance under unpainted as well as under painted conditions. Examples are seen in the products available on the market under the names of Zincrometal and DuraSteel, whose processes consist of, for the former, steel sheet - application of aqueous chromate solution - zinc-rich paint, and for the latter, plated steel sheet - application of aqueous chromate solution - coating of organic/inorganic composite resin.

Generally speaking, dry-in-place type chromate treatment of steel sheet, aluminum sheet or plated steel sheet takes a process [coiled stock - application of aqueous chromate solution - roll squeezing - force drying (sheet temperature: 50°–100° C.)-coiling].

The chromate coating formed on metal sheet surface by such process weights 5–200 mg/m$^2$ as the amount of chromium in the coating.

An additional step is also available in dry-in-place type chromate treatment, wherein after the application of the aqueous chromate solution, coating the work with aqueous organic resin solution is conducted to form a coating of 0.1–3 g/m$^2$. In this case, drying is done at a sheet temperature between 50°–100° C. In case it exceeds 80° C., water cooling is done in the next stage.

Steel sheet chromate-coated as above mentioned is typically subjected to a forming process at user's factory and then to cleaning and painting.

Problems arise from the cleaning stage of the formed work in that part of the chromate coating dissolves out in the cleaning solution, which leads to degradation of the performance of the coating; the dissolved out substance mainly comprises hexavalent chromium which is undesirable also because it contaminates the cleaning solution and poses pollution problems. In order to prevent such dissolution, trivalent chromium or resin have been included in the chromating solution, conducting organic resin or organic/inorganic composite resin coating have been applied after the chromate solution application, or the work has been subjected to high temperature baking after chromate solution application. However, the method of mixing trivalent chromium and resin in the aqueous chromate solution per se is incapable of sufficiently preventing the chromate coating from dissolution, and even organic resin or organic-/inorganic composite resin coating applied thereafter cannot afford complete counter-measure. Baking at high temperature after chromate coating also is not preferable from the aspects of energy consumption as well as from the space requirements for erecting a baking oven.

The present invention aims at preventing dissolution of chromate coating during the cleaning stage, thereby keeping the chromate coating at the same level of performance as it has as initially applied as well as for the purpose of preventing hexavalent chromium from dissolving out into the cleaning solution.

SUMMARY OF THE INVENTION

It has been found that the chromate coating formed on a metal surface by employing a process with the sequence of (1) contact with aqueous chromate solution on metal sheet surface, (2) force drying, (3) contact with reducing agent containing aqueous solution substantially prevents dissolving out during the cleaning stage and maintains a level of performance near to that prior to cleaning.

DETAILED DESCRIPTION OF THE INVENTION

Due to the high speed of most coil lines, the contact time length is short so the present invention requires a strong reducing agent to be highly effective, for which hydrazine, hydroxylamine, and their salts such as hydrazine phosphate, which are nitrogen containing reducing agents, are examples.

Water rinsing can be effected after the treatment with the aqueous reducing agent solution in order to remove the remaining reducing agent though this is not indispensable.

The concentration of reducing agent in its aqueous solution is preferably in the range of from 1 to 100 g/l, and more preferably from 30–80 g/l. Lower concentration cannot afford any significant effect and with higher concentration, increasing disadvantages are brought about from the aspects of safety, hygienics and economy.

In the present invention, as described in the Japanese Patent Laid-Open No. SHO 50-158535 (1975) with the title of invention, Method of Dry-in-Place Type Chromate Treatment, an aqueous mixture solution of anhydrous chromic acid, phosphoric acid and trivalent chromium is also usable; also, as described in the Japanese Patent Laid-Open No. SHO 53-2358 (1978) ultraviolet ray or electron beam radiation is also available as a method for hardening a chromate coating.

EXAMPLE 1

Electrogalvanized steel sheet was subjected to the following process in the order of (1) spray cleaning with an aqueous solution containing sodium phosphate and sodium silicate as the main cleaning agents, (2) spray water rinsing, (3) application of aqueous chromate solution (water-soluble acrylic resin : 86 g/l net solids, $Cr^{6+}$: 3.2 g/l, $Cr^{3+}$: 1.0 g/l, defoaming agent : 0.4 g/l), (4) force drying (sheet temperature : 80° C.), (5) spraying of aqueous hydrazine solution having 50 g/l concentration for 3 seconds at 0.5 kg/cm$^2$ pressure (at temperatures, 20° C., 50° C. and 80° C.), (6) hot air drying, (7) cooling at room temperature, (8) spraying of aqueous solution containing sodium phosphate and sodium silicate as the main cleaning agents (2% of concentration, 58–62° C., for 2 minutes, spray pressure : 0.5 kg/cm$^2$), (9) spray water rinsing, (10) hot air drying; meanwhile, intermediate zones between each stage are provided with pinch rolls.

Figure 1:
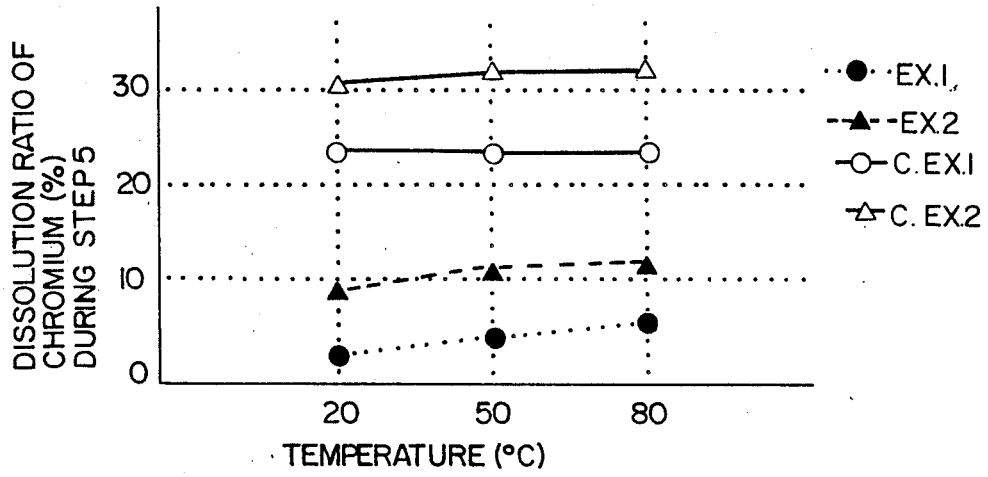
FIG. 1 graphically indicates the dissolution ratio of chromium from the chromate coating taking place during the treatment with aqueous hydrazine solution or with water.
Figure 2:
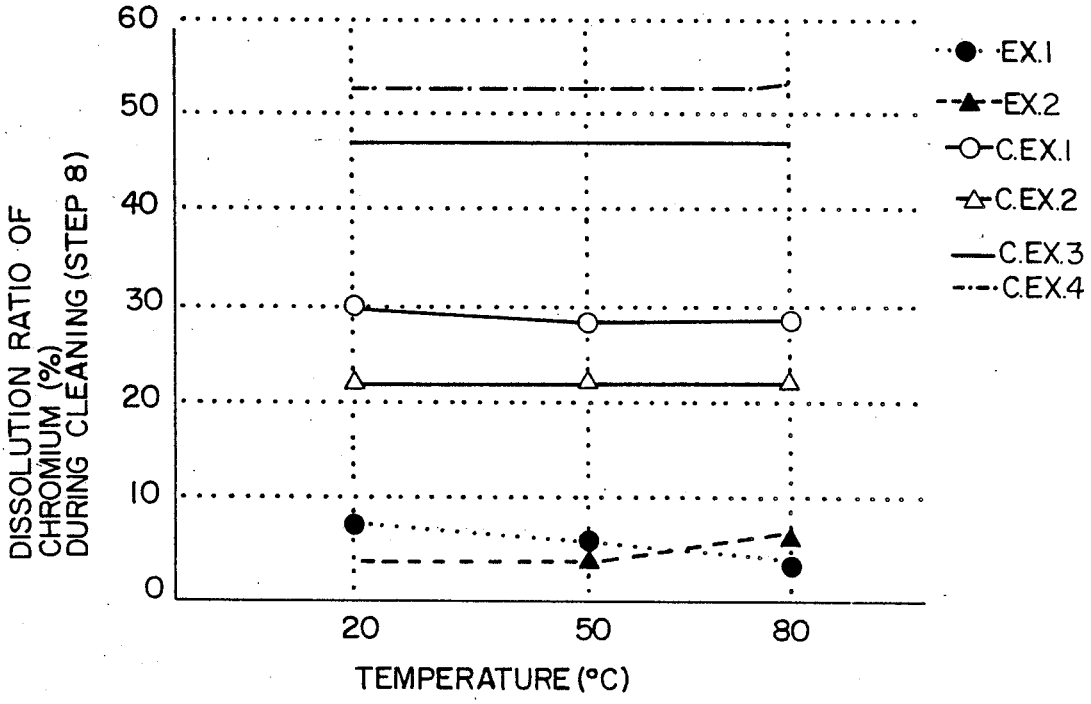
FIG. 2 graphically indicates the dissolution ratio of chromium from the chromate coating during the cleaning treatment.

The work thus treated was examined for the dissolution ratio of chromium of the chromate coating in the aqueous hydrazine treatment solution (amount of chromium dissolved out from chromate coating/ amount of chromium in the coating prior to aqueous hydrazine solution treatment x 100). The result is as shown graphically in FIG. 1. Also, the dissolution ratio of chromium of the chromate coating seen in the case of cleaning treatment was determined (amount of chromium dissolved out/amount of chromium in the coating prior to cleaning treatment x 100). FIG. 2 graphically indicates the result.

Table 1 indicates the result obtained in the 5% salt spray test on the chromate treated steel sheet cleaned, water rinsed and dried.

EXAMPLE 2

The same process as in the case of Example 1 was conducted except for the aqueous chromate solution, for which an aqueous solution containing 86 g/l net solids of ethylene diacrylate copolymer and 10 g/l of $(NH_4)_2Cr_2O_7$ was used. FIG. 1, 2 and Table 1 show the result.

COMPARATIVE EXAMPLE 1

The same process as in the case of Example 1 was conducted except for the aqueous hydrazine solution, which was changed to water. The result is as indicated in FIG. 1, FIG. 2 and Table 1.

COMPARATIVE EXAMPLE 2

The same process as in the case of Example 2 was conducted except for the aqueous hydrazine solution, which was changed to water. The result is as indicated in FIG. 1, FIG. 2 and Table 1.

COMPARATIVE EXAMPLE 3

The same process as in the case of Example 1, was conducted except that the treatment with aqueous hydrazine solution was eliminated. The result is shown in FIG. 2 and Table 1.

COMPARATIVE EXAMPLE 4

The same process as in the case of Example 2 was conducted except that the treatment with aqueous hydrazine solution was eliminated. The result is shown in FIG. 2 and Table 1.

TABLE 1

| | | RESULT ON SALT SPRAY TEST | | | | |
|---|---|---|---|---|---|---|
| | | Cooling Treatment (Step 5) Condition | | S.S.T. 200 Hr. Area of White Rust Occurrence | | |
| | | | Temperature (°C.) | Before Cooling | After Cooling | After Alkali Cleaning |
| Examples | 1 | Hydrazine | 20 | 0 | 0 | 0 |

TABLE 1-continued

| | | RESULT ON SALT SPRAY TEST | | | | |
|---|---|---|---|---|---|---|
| | | Cooling Treatment (Step 5) Condition | | S.S.T. 200 Hr. Area of White Rust Occurrence | | |
| | | | Temperature (°C.) | Before Cooling | After Cooling | After Alkali Cleaning |
| | | 50 g/l | 50 | 0 | 0 | 0 |
| | | | 80 | 0 | 0 | 2 |
| | 2 | | 20 | 10 | 20 | 30 |
| | | | 50 | 10 | 20 | 30 |
| | | | 80 | 10 | 30 | 50 |
| Comparative Examples | 1 | Water | 20 | 0 | 30 | 50 |
| | | | 50 | 0 | 40 | 60 |
| | | | 80 | 0 | 40 | 60 |
| | 2 | | 20 | 10 | 100 | 100 |
| | | | 50 | 10 | 100 | 100 |
| | | | 80 | 10 | 100 | 100 |
| | 3 | Without | | 0 | | 5 |
| | 4 | | | 10 | | 80 |

Taking 50° C. for example, the chromate treatment of Example 1 resulted in a chromate dissolution in Step 5 and Step 8 of 4% and 7% respectively, whereas in Comparative Example 1 the corresponding dissolutions were 22% and 28% respectively and in Comparative Example 3, where no Step 5 was employed, 48% dissolution was experienced during cleaning Step 8. Table 1 shows substantial improvement in salt spray results for Example 1 compared to Comparative Examples 1 and 3. Similar results are demonstrated for the different Step 5 temperatures and the different chromate solution of Example 2 and Comparative Examples 2 and 4.

What is claimed is:

1. A process for producing a dissolution resistant protective coating containing chromate on a metallic surface, said process comprising the steps of:
   (A) contacting the metal surface with an aqueous chromium containing solution;
   (B) drying the surface contacted in step (A); and
   (C) contacting the dried surface from step (B) with an aqueous solution containing hydraxine in a reducing-effective amount under reducing-effective conditions.

2. The process of claim 1 wherein in step (C) hydrazine is present in an amount of about 1–100 grams per liter of water.

3. The process of claim 2 wherein in step (C) hydrazine is present in an amount of about 30–80 grams per liter of water.

4. The process of claim 3 wherein in step (C) hydrazine is present in an amount of about 50 grams per liter of water.

5. The process of claim 1 wherein the chromate coating is water rinsed after step (C) to remove any remaining hydrazine.

6. The process of claim 1 wherein said chromate coating is hot air dried after step (C).

7. The process of claim 1 wherein contacting during step (C) is at a temperature of about 20°–80° C.

8. The process of claim 1 wherein contacting during step (C) is by spraying.

9. The process of claim 1 wherein the contacting of said metallic surface during step (A) is effected with an aqueous solution of anhydrous chromic acid, phosphoric acid, and trivalent chromium.

10. The process of claim 1 wherein the contacting of said metallic surface during step (A) is effected with an aqueous solution of ethylene diacrylate polymer and $(NH_4)_2Cr_2O_7$.

11. The process of claim 1 wherein the contacting of said metallic surface during step (A) is effected with an aqueous solution of a water-soluble acrylic resin, hexavalent chromium ions, and trivalent chromium ions.

* * * * *